US005262266A

United States Patent [19]

Houle et al.

[11] Patent Number: 5,262,266

[45] Date of Patent: Nov. 16, 1993

[54] HALOGENATED CHARGE DIRECTORS FOR LIQUID DEVELOPERS

[75] Inventors: William A. Houle, Brevard, N.C.; Daniel McClain, Hughesville, Pa.

[73] Assignee: Xerox Corporation, Rochester, N.Y.

[21] Appl. No.: 807,921

[22] Filed: Dec. 16, 1991

[51] Int. Cl.[5] ..... G03G 9/135

[52] U.S. Cl. ..... 430/115

[58] Field of Search ..... 430/116, 112, 114, 115, 430/137

[56] References Cited

U.S. PATENT DOCUMENTS

| | | | |
|---|---|---|---|
| 3,852,208 | 12/1974 | Nagashima et al. | 252/62.1 |
| 3,933,664 | 1/1976 | Nagashima et al. | 252/62.1 |
| 4,113,641 | 9/1978 | Brana et al. | 252/62.1 |
| 4,139,483 | 2/1979 | Williams et al. | 252/62.1 |
| 4,229,513 | 10/1980 | Merrill et al. | 430/115 |
| 4,248,954 | 2/1981 | Datta et al. | 430/97 |
| 4,268,598 | 5/1981 | Leseman et al. | 430/107 |
| 4,388,396 | 6/1983 | Nishibayashi et al. | 430/126 |
| 4,468,446 | 8/1984 | Mikami et al. | 430/138 |
| 4,524,119 | 6/1985 | Luly et al. | 430/108 |
| 4,824,750 | 4/1989 | Mahalek et al. | 430/99 |
| 4,869,991 | 9/1989 | deGraft et al. | 430/115 |
| 4,963,456 | 10/1990 | Shin et al. | 430/109 |
| 5,002,847 | 3/1991 | Utsumi et al. | 430/137 |
| 5,019,477 | 5/1991 | Felder | 430/115 |
| 5,026,621 | 6/1991 | Tsubuko et al. | 430/109 |
| 5,030,535 | 7/1991 | Drappel et al. | 430/116 |
| 5,034,299 | 7/1991 | Houle et al. | 430/115 |
| 5,041,625 | 8/1991 | Wilson et al. | 430/110 |
| 5,075,190 | 12/1991 | Alexandrovich et al. | 430/115 |

*Primary Examiner*—John Goodrow
*Attorney, Agent, or Firm*—Oliff & Berridge

[57] ABSTRACT

A liquid developer contains a liquid carrier, a halogenated charge director and toner particles. Preferably, the charge director contains a fluorinated portion and a hydrocarbon portion. The charge director provides a developer which is fully charged but has a very small residual conductivity, thus providing a high quality image.

21 Claims, No Drawings

HALOGENATED CHARGE DIRECTORS FOR LIQUID DEVELOPERS

This invention is directed to a liquid developer and, in particular, to a liquid developer containing a halogenated charge director.

BACKGROUND OF INVENTION

A latent electrostatic image can be developed with toner particles dispersed in an insulating non-polar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet.

Useful liquid developers comprise a thermoplastic resin and a dispersant non-polar liquid. Generally, a suitable colorant, such as a dye or pigment, is also present. The colored toner particles are dispersed in a non-polar liquid which generally has a high volume resistivity in excess of $10^9$ ohm-centimeters, a low dielectric constant (e.g. below 3.0) and a high vapor pressure. Generally, the toner particles are less than 30 μm average by area size as measured using the Malvern 3600E particle sizer.

Because the formation of proper images depends on the difference of the charge between the toner particles in the liquid developer and the latent electrostatic image to be developed, it has been found desirable to add a charge director compound and other adjuvants which increase the magnitude of the charge, e.g., polyhydroxy compounds, aminoalcohols, polybutylene succinimide compounds, aromatic hydrocarbons, metallic soaps, etc., to the liquid developer comprising the thermoplastic resin, the non-polar liquid and the colorant. A charge director plays a critical role in controlling the charging properties of the toner to produce good quality images.

U.S. Pat. No. 5,019,477 to Felder, the contents of which are hereby incorporated by reference, discloses a liquid electrostatic developer comprising a non-polar liquid, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthanates. The thermoplastic resin particles comprise a mixture of (i) a polyethylene homopolymer or a copolymer of (i) polyethylene and (ii) acrylic acid, methacrylic acid or alkyl esters thereof, wherein (ii) comprises 0.1-20 weight percent of the copolymer; and (2) a random copolymer of (iii) selected from the group consisting of vinyltoluene and styrene and (iv) selected from the group consisting of butadiene and acrylate. As the copolymer of polyethylene and methacrylic acid or methacrylic acid alkyl esters, Nucrel® may be used.

U.S. Pat. No. 5,030,535 to Drappel et al. discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C.-120° C., adding pigment to the hot polymer solution and attriting the mixture, and then cooling the mixture so that the polymer becomes insoluble in the liquid vehicle, thus forming an insoluble resin layer around the pigment particles.

U.S. Pat. Nos. 3,852,208 and 3,933,664, both to Nagashima et al., disclose colored, light-transparent photoconductive material which is obtained by a condensation reaction of organic photoconductive substances with reactive colored components. The chemical combination of an organic photoconductive substance having at least one amino or hydroxyl group with a color development component having at least one active halogen atom produces the color developing organic photoconductive materials. Alternatively, the color developing materials can be obtained from the combination of an organic photoconductive substance having at least one active halogen atom with a color developing component having at least one amino or hydroxyl group. The color developing organic photoconductive material may be pulverized in a ball-mill, a roll-mill or an atomizer to produce a toner for use as a dry or wet developing agent, or may be used in combination with other colored substances or vehicle resins.

U.S Patent No. 4,524,119 to Luly et al. discloses electrophotographic dry development carriers for use with toner particles wherein the carrier core particles are coated with fluorinated carbon or a fluorinated carbon-containing resin. By varying the fluorine content of the fluorinated carbon, systematic uniform variation of the resistivity properties of the carrier is permitted. Suitable binders for use with the carrier core particles may be selected from known thermoplastics, including fluoropolymers.

U.S. Pat. No. 5,026,621 to Tsubuko et al. discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer and the compatible segment thereof is oriented to be compatible with other resins and a coloring agent contained in the toner, so that the toner is provided with both liquid-repelling and solvent-soluble properties.

U.S. Pat. No. 4,248,954 to Datta et al. discloses carrier particles, for use with a dry toner composition in an electrophotographic process, which are prepared by coating the surface of the carrier particles with a perfluoro carboxylic acid in a polymeric binder. The carrier particles are capable of imparting a positive triboelectric charge to toners used with these carrier particles.

U.S. Pat. No. 4,268,598 to Leseman et al. discloses a developing powder composition prepared by blending a fluoroaliphatic sulfonamido surface active agent with a desired formulation of toner powder particles. The toner powders are flowable, finely divided dry powder that are generally colored and are preferably conductive and magnetically attractable.

U.S. Pat. No. 4,139,483 to Williams et al. discloses a finely divided dry toner composition comprising a colorant, a thermoplastic resin, and a surface active additive which is capable of providing a desired polarity and magnitude of triboelectric charging potential to the toner composition. The surface active additives are selected from highly fluorinated materials.

U.S. Pat. No. 4,113,641 to Brana et al. discloses a dry development powder with a high charge to mass ratio comprising a carrier particle treated with a perfluoroalkyl sulfonic acid. The core of the carrier particle is any material which can react chemically with perfluoro sulfonic acid, and is preferably a ferromagnetic material such as iron or steel.

U.S. Pat. No. 4,388,396 to Nishibayashi et al. discloses developer particles comprising pigment particles, a binder and an offset-preventing agent selected from the group consisting of aliphatic fluorocarbon compounds and fluorochlorocarbon compounds. Electrical conductivity can be imparted to the developer by causing electrically conductive fine particles to adhere to the surfaces of the particles.

U.S. Pat. No. 4,468,446 to Mikami et al. discloses a dry electrostatographic toner for a pressure fixing process which comprises encapsulated toner particles with a pressure fixable adhesive core material containing a colorant and a pressure rupturable shell enclosing the core material, wherein the outer surface of the shell is an organofluoro compound.

SUMMARY OF THE INVENTION

It is an object of the present invention to provide a liquid developer capable of high particle charging.

It is a further object of the invention to provide a liquid developer wherein excess charge director in solution has a small contribution to the conductivity of the developer.

It is yet a further object of the invention to provide a fully charged liquid developer having residual conductivities of close to zero.

It is still a further object of the invention to provide a liquid developer wherein defects such as smearing, loss of resolution and loss of density are eliminated.

These and other objects are satisfied by a liquid developer which includes a liquid carrier, a halogenated charge director and toner particles.

DETAILED DESCRIPTION OF PREFERRED EMBODIMENTS

The present invention provides a liquid developer which comprises a liquid carrier, a halogenated charge director and toner particles.

The liquid carrier of the claimed invention is a non-polar liquid having a kauri-butanol value of less than 30, and is employed as a dispersant in the present invention, wherein the halogenated charge director and toner particles are dispersed. Preferably it is a branched-chain aliphatic hydrocarbon. A non-polar liquid of the Isopar ® series (manufactured by the Exxon Corporation) may be used in the present developers. These hydrocarbon liquids are narrow cuts of isoparaffinic hydrocarbon fractions with extremely high levels of purity. For example, the boiling range of Isopar ®G is between about 157° C. and 176° C.; Isopar ®H is between about 176° C. and 191° C.; Isopar ®K is between about 177° C. and 197° C.; Isopar ®L is between about 188° C. and 206° C.; Isopar ®M is between about 207° C. and 254° C.; and Isopar ®V is between about 254.4° C. and 329.4° C. Isopar ®L has a mid-boiling point of approximately 194° C. Isopar ®M has an auto ignition temperature of 338° C. Isopar ®G has a flash point of 40° C. as determined by the tag closed cup method; Isopar ®H has a flash point of 53° C. as determined by the ASTM D-56 method; Isopar ®L has a flash point of 61° C. as determined by the ASTM D-56 method; and Isopar ®M has a flash point of 80° C. as determined by the ASTM D-56 method.

All of the non-polar liquids in the present invention should have an electrical volume resistivity in excess of $10^9$ ohm-centimeters and a dielectric constant below 3.0. Moreover, the vapor pressure at 25° C. should be less than 10 torr.

While the Isopar ® series liquids are the preferred non-polar liquids for use as dispersants in the present liquid developers, the essential characteristics of all suitable non-polar liquids is the kauri-butanol value. Specifically, the non-polar liquids employed in the present liquid electrostatic developers have a kauri-butanol value of about 25 to about 30, and preferably about 27 to 28, as determined by the ASTM D-1136 method.

The kauri-butanol value can be defined as a measure of the aromatic content (and hence, the solvent power) of a hydrocarbon liquid. The kauri-butanol value is a measure of the volume of solvent required to produce turbidity in a standard solution containing kauri gum dissolved in butanol. Kauri gum is readily soluble in butanol but insoluble in hydrocarbons. Accordingly, low kauri-butanol values represent non-polar aliphatic solvents with high dielectric constants and low volume resistivities.

The amount of the non-polar liquid employed in the developer of the present invention is about 90–99.9 percent, and preferably 95–99 percent by weight of the total developer dispersion. The total solids content of the present developers is 0.1 to 10 percent by weight, preferably 0.3 to 3 percent and more preferably 0.5 to 2.0 percent by weight.

Any suitable thermoplastic toner resin may be employed in the liquid developer of the present invention. Examples of such resins include ethylene vinyl acetate (EVA) copolymers (Elvax ® resins, E. I. Du Pont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80–99.9%), acrylic or methacrylic acid (20 to 0.1%)/alkyl ($C_1$ to $C_5$) ester of methacrylic or acrylic acid (0.1 to 20%); polyethylene; polystyrene; isotactic polypropylene (crystalline); ethylene ethyl acrylate series sold under the trademark Bakelite ® DPD 6169, DPDA 6182 Natural (Union Carbide Corp., Stamford, Conn.); ethylene vinyl acetate resins, e.g., DQDA 6832 Natural 7 (Union Carbide Corp.); Surlyn ® ionomer resin (E. I. Du Pont de Nemours and Company); etc., or blends thereof; polyesters; polyvinyl toluene; polyamides; styrene/butadiene copolymers; epoxy resins; acrylic resins, such as a copolymer of acrylic or methacrylic acid (optional but preferred) and at least one alkyl ester of acrylic or methacrylic acid wherein alkyl is 1 to 20 carbon atoms, e.g., methyl methacrylate (50 to 90%)/methacrylic acid (0 to 20%/ethylhexyl acrylate (10 to 50%); and other acrylic resins including Elvacite ® Acrylic Resins (E. I. du Pont de Nemours and Company); or blends of the resins. Preferred copolymers are the copolymer of ethylene and an $\alpha$-$\beta$-ethylenically unsaturated acid of either acrylic acid or methacrylic acid. In a preferred embodiment, Nucrel ® is used as the thermoplastic resin.

The liquid developer of the present invention may optionally contain a colorant dispersed in the resin particles. Colorants, such as pigments or dyes and combinations thereof, are preferably present to render the latent image visible.

The colorant may be present in the resin particles in an amount of from about 01 to about 60 percent, and preferably from about 1 to about 30 percent by weight based on the total weight of solids contained in the developer. The amount of colorant used may vary depending on the use of the developer. Examples of pigments which may be used in the present developers may include those set forth in the following table.

| Pigment Brand Name | Manufacturer | Color |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chem. | Yellow 14 |
| L75-1331 Yellow | Sun Chem. | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| L75-2337 Yellow | Sun Chem. | Yellow 83 |
| Cromophthal ® Yellow 3G | Ciba-Geigy | Yellow 93 |
| Cromophthal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophthal ® Yellow 8G | Ciba-Geigy | Yellow 128 |
| Irgazine ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue TBD 7010 | BASF | Blue:3 |
| Heliogen ® Blue K 7090 | BASF | Blue 15:3 |
| Heliogen ® Blue L 7101F | BASF | Blue 15:4 |
| Heliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet | Ciba-Geigy | Violet 19 |
| Monastral ® Red | Ciba-Geigy | Violet 19 |
| Quindo ® Red 6700 | Mobay | Violet 19 |
| Quindo ® Red 6713 | Mobay | Violet 19 |
| Indofast ® Violet | Mobay | Violet 19 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul ® L 77266 | Cabot | Black, CI |
| Uhlich ® BK 8200 | Paul Uhlich | Black |

Charge director compounds of the present invention include halogenated compounds which are soluble or sparingly soluble in the liquid carrier. The charge director compounds are added to the liquid carrier and solubilized, preferably by sonication.

The halogenated charge director compound is bifunctional, i.e., possesses both charging capability and solubility in the liquid carrier. These properties are generally provided by two portions of the compound. The portion of the charge director compound which is halogenated is that portion which is most critical in the compound because it provides the charging capability; it is a halogenated portion which is generally insoluble in the liquid carrier. Any portion of the charge director compound which is not halogenated must be soluble in the liquid carrier. If the halogenated portion is soluble in the liquid carrier, it is not necessary that a second portion be present.

The charge director of the present invention may be a straight- or branched-chain, cyclic aliphatic or aromatic compound. A halogenated portion of the charge director may contain fluorine, chlorine or bromine, preferably fluorine, or any mixture thereof, and may be completely or only partially halogenated. Compounds such as the following are examples of charge directors of the invention:

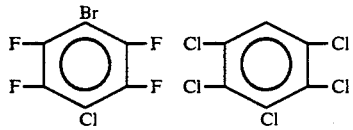

and

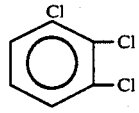

The halogenated portion of the compound may be straight- or branched-chain, cyclic aliphatic or aromatic. The following compounds are examples of at least partially aliphatic structure charge directors of the invention:

$$CX_3—(CX_2)_m—(CH_2)_n—R$$

Wherein:

X is a halogen independently selected from the group consisting of F, Cl and Br, preferably F;

m is 3–20, preferably 3–8;

n is 2–30, preferably 2–12;

R is H or any unsubstituted or substituted hydrocarbon which provides solubility to the charge director compound in a toner dispersant liquid carrier.

The hydrocarbon portion of the compound may be straight- or branched-chain, cyclic aliphatic or aromatic. The hydrocarbon portion may be saturated or unsaturated. The hydrocarbon portion must contain a sufficient number of carbons to ensure that the compound is soluble in the liquid carrier. The R moiety of the hydrocarbon portion may be hydrogen or may be any unsubstituted or substituted hydrocarbon including, but not limited to, alkyl, alkenyl and alkynyl hydrocarbons, esters, alcohols, acids and bases.

Preferably, fluorinated compounds are used for the charge directors of the invention. In particular, fluorinated compounds of the present invention are soluble in Isopar ® and are used as to make positive toners. Examples of fluorinated compounds preferred for use as charge directors in the invention include Zonyl ® surfactants (E. I. du Pont de Nemours and Company, Wilmington, Del.).

The charge director compounds may be used in amounts of about 0.05 to about 50 grams, preferably 0.1 to 30 grams and most preferably about 1 to about 5 grams, of a saturated solution of the charge director compound in the liquid carrier per gram of toner solids.

The total conductivity of a liquid developer is a measure of the charge which is on the toner particles and on the micelles which are formed by the charge director in solution. The excess charge director is thought to exist as inverse micelles in the carrier liquid. The presence of charge on micelles of the charge director may contribute to poor image quality because it is possible for the micelles to reach the image areas before the toner particles arrive to form an image. Ideally, a liquid developer will have fully charged toner particles with no residual or background conductivity due to the charge director micelles. Reducing the concentration of the excess charge directors is generally not an option since the charge on the toner particles will also be reduced. It is preferable to use a charge director that has an inherently low residual conductivity, but at the same time imparts a high charge to the toner particle.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the liquid developer. The faster it moves through the field, the better the image created by the toner particle. Residual conductivity, i.e. the conductivity from the charge director, is measured using a low field device as described in the examples.

In the present invention, while the toner particle charging as measured above may be high, the excess charge director micelles in solution contribute very little to the residual conductivity of the liquid developer. Thus, fully charged liquid developer solutions may be achieved wherein the residual conductivity of the liquid developer (i.e., the net charge resulting from the charge director micelles present) is close to zero.

In order to increase the toner particle charge and, accordingly, increase the mobility and transfer latitude of the toner particles, charge adjuvants may also be added to the toner particles. For example, adjuvants, such as metallic soaps (e.g., aluminum or magnesium stearate or octoate), fine particle size oxides (such as oxides of silica, alumina, titania, etc.), para-toluene sulfonic acid, and polyphosphoric acid, may be added when producing a developer containing chargeable toner particles Negative charge adjuvants increase the negative charge of a toner particle, while the positive charge adjuvants increase the positive charge of the toner particles. The adjuvants are added to the present toner particles in an amount of from about 1 to about 1000 mg/g and preferably from about 5 to about 60 mg/g of the total weight of solids contained in the developer.

Examples of the above-noted metallic soaps are aluminum stearate; aluminum tristearate; aluminum distearate; barium, calcium, lead and zinc stearates; cobalt, manganese, lead and zinc linoleates; aluminum; calcium ad cobalt octoates; calcium and cobalt oleates; zinc palmitate; calcium, cobalt, manganese, lead and zinc naphthanates; calcium cobalt, manganese, lead and zinc resinates, etc.

Other charge adjuvants which may be used in the present toner particles are the polyhydroxy compounds, i.e., those which contain at least two hydroxy groups and polybutylene/succinimide compounds. These adjuvants may also be used in amounts of from about 1 to 1,000 mg/g, and preferably from about 5 to 60 mg/g, of the total amount of solids contained in the developer.

Examples of these compounds are as follows:

I) Polyhydroxy compounds include ethylene glycol; 2,4,7,9-tetramethyl-5-decyn-4,7-diol; poly(propylene glycol); pentaethyelne glycol; tripropylene gycol; triethylene glycol; glycerol; pentaerythritol; glycerltri-12 hyroxystearate; ethylene glycol monohydroxystearate, propylene glycerol monohydroxy-stearate, etc.

II) Polybutylene/succinimide compounds include OLOA ®-1200 by Chevron Crop. and Amoco 575 having a number average molecular weight of about 600 (vapor pressure osmoetry) made by reacting maleic anhydrdide which in turn is reacted with a polyamine. Amoco 575 is 40 to 45% surfactant, 36% aromatic hydrocarbon, with the remainder being oil.

The liquid electrostatic developer of the invention can be prepared by a variety of processes known to those skilled in the art such as, for example, mixing, in a non-polar liquid have a kauri-butanol value of less than 30, the thermoplastic resin, nonpolar liquid and optional colorant described above, so that the resulting mixture contains about 15–30 percent by weight of solids; heating the mixture to a temperature from about 70° C. to about 130° C. until a uniform dispersion is formed; adding an additional amount of non-polar liquid sufficient to decrease the total solids concentration of the developer to about 10–20 percent by weight; cooling the dispersion to about 10° C. to about 50° C.; adding the charge director compound to the dispersion; and diluting the dispersion to working strength.

In the initial mixture, the resin and optional colorant and adjuvant may be added separately to an appropriate vessel such as, for example, an attritor, heated ball mill, heated vibratory mill (such as a Sweco Mill manufactured by Sweco Co., Los Angeles, Calif.) equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials, e.g., spherical, cylindrical, etc. selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 mm).

Enough non-polar liquid is added to provide a dispersion of about 15–30 percent solids. This mixture is subjected to elevated temperatures during the initial mixing procedure in order to plasticize and soften the resin. The mixture must be sufficiently heated to provide a uniform dispersion of all solid materials (e.g., colorant, adjuvant and resin). However, the temperature at which this step is undertaken must not be so high as to degrade the non-polar liquid or decompose the resin or colorant if present. Accordingly the mixture is heated to a temperature of from about 70° C. to about 130° C., and preferably to about 75° C. to about 110° C. The mixture may be ground at this temperature for about 15 minutes to 5 hours, and preferably about 45 to about 90 minutes.

After grinding at the above temperatures, an additional amount of non-polar liquid may be added to the dispersion. The amount of non-polar liquid to be added at this point should be an amount sufficient to decrease the total solids concentration of the dispersion to about 10–20 percent by weight.

The dispersion is then cooled to about 10° C. to about 50° C., and preferably to about 15° C. to about 30° C., while mixing is continued, until the resin admixture solidifies or hardens. Upon cooling, the resin admixture precipitates out of the dispersant liquid. Cooling is accomplished by means known to those skilled in the art such as, for example, gravity feed methods, vacuum filtration methods, etc. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding (e.g., by means of particulate media); or with stirring to form a viscous mixture and grinding by means of particulate media. The resin precipitate is cold ground for about 1 to 36 hours, and preferably 2–6 hours. Additional liquid may be added at any step during the preparation of the liquid developer to facilitate grinding or to dilute the developer to the appropriate percent solids needed for developing.

A charge director of the invention is then added to impart a charge to toner particles in the developer, as desired, optionally in a small amount of the liquid carrier.

In addition to the method described above, a charge director of the invention may be added to commercially available developer compositions. If the liquid developer is formed in this manner, the same ratio of charge director to liquid developer as described above will apply.

The invention will further be illustrated in the following non-limiting examples, it being understood that these examples are intended to be illustrative only and that the invention is not intended to be limited to the materials, conditions, process parameters and the like recited herein.

Preparation 1

171 grams of a copolymer of ethylene (91%) and methacrylic acid (9%) (melt index at 190° C. is 500, Acid Number is 60), 42.8 grams of carbon black pigment (Sterling NS Black Pigment, Cabot Corporation, Boston, Mass.), and 817 grams of Isopar ®L (Exxon Corporation) are added to a Union Process IS attritor (Union Process Co., Akron, Ohio) charged with 0.1857 inch (4.7 mm) diameter carbon steel balls. The mixture is milled at 100° C. for 1 hour and cooled to 15° C. 535 grams of Isopar ®L are added to bring the percent solids to 12% and the mixture is separated from the steel balls.

Preparation 2

318 grams of a copolymer of ethylene (91%) and methacrylic acid (9%) (melt index at 190° C. is 500, Acid Number is 60), 1,700 grams of Isopar ®L (Exxon Corporation) and 106 grams of a carbon black pigment (Mogul ®L, Cabot Corporation, Boston, Mass.) are added to a Union Process IS attritor charged with 0.1857 inch (4.76 mm) diameter carbon steel balls. The mixture is milled at 100° C. for 1 hour and cooled to 25° C. and milled for another 2 hours. An additional 1,200 grams of Isopar ®L is added to bring the percent solids to 12% and the mixture is separated from the steel balls. The particle size is 7.8 microns for the V(50) (the volume weighted average particle size) measured with a Malvern 3600E particle size analyzer.

Preparation 3

254 grams of terpolymer of methyl methacrylate (67%), methacrylic acid (3%) and ethylhexylacrylate (30%) (Acid Number is 13), 64 grams of cyan pigment (NBD 7010, BASF, Holland, Mich.), 3.2 grams of para-nitrobenzoic acid and 1284 grams of Isopar ®L (Exxon Corporation) are added to a Union Process IS attritor charged with 0.1857 inch (4.76 mm) diameter carbon steel balls. The mixture is milled at 100° C. for 1 hour and cooled to 20° C. 535 grams of Isopar ®L are added, and the mixture is milled for another 2 hours. An additional 250 grams of Isopar ®L are added to bring the percent solids to 12% and the mixture is separated from the steel balls. The particle size is 1.5 microns for the V(50) measured with a Malvern 3600E particle size analyzer.

Preparation 4

253 grams of copolymer of ethylene (91%) and methacrylic acid (9%) (melt index at 190° C. is 500, Acid Number is 60), 64 grams of a cyan pigment (NBD 7010, BASF, Holland, Mich.), 3.2 grams of para-nitrobenzoic acid and 1,284 grams of Isopar ®L (Exxon Corporation) are added to a Union Process IS attritor charged with 0.1857 inch (4.76 mm) diameter carbon steel balls. The mixture is milled at 100° C. for 1 hour and cooled to 25° C. 535 grams of Isopar ®L are added, and the mixture milled for another 4 hours. An additional 1200 grams of Isopar ®L are added to bring the percent solids to 12%. The particle size is 9.5 microns for the V(50) measured with a Malvern 3600E particle size analyzer.

Isolation and Extraction of Zonyl Surfactants

A solvent (indicated below) is added to a Zonyl ® (du Pont de Nemours and Company) fluorosurfactant solution causing the fluorosurfactant to precipitate. This precipitate is filtered, and residual solvent is removed by heating gently. The resulting powder is ground and further dried overnight in a vacuum oven at 10 torr. This procedure is followed to remove residual water or alcohol which can affect toner performance. The extracted fluorosurfactants are employed in the charge director solutions described below.

| Material | Extraction Solvent |
|---|---|
| FSA | acetone |
| FSJ | methylene chloride |
| FSC | acetone |
| TBS | acetone |
| FTS | (Extraction solvent not required) |

The fluorosurfactant FSA is characterized by an acidic substituent, $—S—CH_2—CH_2—COO^-Li^+$. FSJ is characterized by the substituent $—PO_4^{-2}(NH_4^+)_2$. FSC is characterized by the substituent $—S—CH_2—CH_2—N^+(CH_3)_3CH_2CO_2^-$. TBS is characterized by the substituent $—SO_3—Q^+$, wherein Q is H or $NH_4$. FTS is characterized by the substituent $-O-\underset{\underset{O}{\|}}{C}-C_{17}H_{35}$.

Particle mobility is measured using an Electro Minetic Sonic Amplitude instrument (Matec Inc., Hopkinton, Mass.). Particle mobility correlates with image quality, and acceptable mobilities are observed for the developers of this invention.

| Toner Preparation | Percent Solids | Amount grams | Charge Director | Amount grams | Toner Charge | Conductivity (pmhos/cm) | Part. Mobility (× 10 m 2/V Sec) |
|---|---|---|---|---|---|---|---|
| 1 | 2% | 30 | 1 | 2 | 99% + | <0.5 | 13.1 |
| | | | 2 | | 100% + | <0.5 | 3.4 |
| | | | 3 | | 100% + | <0.5 | 7.0 |
| | | | 4 | | 99% + | <0.5 | 5.3 |
| | | | 5 | | 100% + | <0.5 | 6.2 |
| | | | 6 | | 100% + | <0.5 | 4.9 |
| 2 | 2% | 30 | 1 | 2 | 100% + | <0.5 | 2.0 |
| | | | 2 | | 99% + | <0.5 | 6.9 |
| | | | 3 | | 99% + | <0.5 | 2.6 |
| | | | 4 | | 100% + | <0.5 | 9.0 |
| | | | 5 | | 100% + | <0.5 | 6.8 |
| | | | 6 | | 99% + | <0.5 | 4.9 |
| 3 | 1% | 30 | 7 | 0.3 | 100% + | <0.5 | 4.1 |
| | | | | 0.6 | 100% + | 0.8 | 6.5 |
| 4 | 1% | 30 | 7 | 0.3 | 100% + | <0.5 | 2.0 |
| | | | | 0.6 | 100% + | 0.8 | 3.7 |
| 4 | 1% | 30 | 8 | 0.3 | 100% + | <0.5 | 11.7 |
| | | | | 0.6 | 100% + | <0.5 | 7.0 |

Preparation of charge director solutions

Charge Directors 1 to 3

A 2% solution of the extracted Zonyl ® surfactants TBS (charge director 1), FSJ (charge director 2) and FTS (charge director 3) in Isopar ®L is prepared and sonicated in a bath sonicator for 1 hour. A clear supernatant is decanted from the undissolved material.

Charge Directors 4 to 6

Mixed charge directors are prepared by combining extracted TBS with FTS (40:60 weight ratio). A 2% solution of this mixed fluorosurfactant is prepared in Isopar ®L (charge director 4). A similar procedure is followed for a 25:75 mixture of FSA and FTS (charge director 5). A saturated solution of FSC in FTS is prepared by adding an excess of extracted FSC to FSC, stirring at room temperature and decanting off the clear liquid. A 2% solution of the mixed FSC/FTS in Isopar ® is then prepared (charge director 6).

Charge Directors 7 and 8

A 5% solution of the extracted FTS is prepared with Isopar ®L, and stirred at 80° C. for 5-6 hours. The clear supernatant is decanted off the undissolved material (charge director 7). A similar procedure is followed using the extracted FSA (charge director 8).

EXAMPLE 1

Developer compositions are prepared by diluting preparations 1 to 4 with Isopar ®L as indicated below and adding to 30 gram samples of the diluted charge directors 1 to 8 in the amounts indicated below. Particle polarity, mobilities and solution conductivity were measured after equilibration of 1-2 days. Conductivity is measured in picomhos/cm (pmhos/cm) at 5 hertz and low voltage (5 volts). Conductivities of the toners of this invention are generally less than 0.5 pmhos/cm. Conventional liquid toners generally have conductivities on the order of magnitude from $10^1$ to $10^2$ pmhos/cm. Particle polarity is determined by placing the dilute toner solution between two conducting plates and applying a DC field. Clean charging (>95% positive toner) is observed for the toners of this invention.

EXAMPLE 2

Imaging Results

The following developer is prepared: 81 grams of charge director 1 is added to 2500 grams of a 2% solution in Isopar ®L of toner preparation 1. Solution conductivity is unmeasurable (<0.5 pmhos/cm). Images are obtained on a modified Savin 870 copier.

Image quality of the developers of the invention was determined on a modified Savin 870 copier. This device consists of a Savin 870 copier with the modifications described below.

Mechanical modifications include adding a pretransfer corona and removing the anodized layer from the surface of the reverse roll while decreasing the diameter of the roll spacers to maintain the same gap between the roll and photoconductor.

Electrical modifications include:

(1) disconnecting the image density feedback loop from the development electrode and connecting the electrode to a Keithly high voltage supply (Model 247 Keithly, Cleveland, Ohio), (2) connecting a Keithly high voltage supply (Model 247) to the modified reverse roll, and (3) disconnecting the transfer corona and connecting same to a Trek (Model 610) high voltage supply (Trek, Medina, N.Y.).

The modified Savin 870 is then used to evaluate both positive and negative developers depending on the voltages and biases used. To evaluate positive developers the copier is run in a positive mode: reversed image target is used with negative transfer corona voltages and positive development bias. The reversed image target consists of white characters and lines, etc., on a black background.

The principal of operation is described below. The photoconductor is charged positive (near 1000V) by means of the charging corona. The copy is imaged onto the photoconductor inducing the latter to discharge to lower voltages (in order of increasing discharge-black areas and white areas). When adjacent to the toner electrode the photoconductor has fields at its surface such that positively charged toner will deposit at the white imaged areas, and negatively charged toner at the black imaged areas. If necessary, toner background is removed by the biased reverse roll. The toner is then transferred to paper by the transfer corona (the transfer force due to the charge sprayed on the back of the paper). The toner is then thermal fused.

Imaging and transfer conditions are set up for a positively charged toner: charging corona +6.8 kV, development bias +700 volts, transfer corona −6.0 kV. Transfer efficiency is determined to be 100% at a density of 1.86 on a smooth coated paper stock, and at a density of 1.25 on a plain paper stock. Clear text characters and even density solids are observed.

While the invention has been described with reference to particular preferred embodiments, the invention is not limited to the specific examples given, and other embodiments and modifications can be made by those skilled in the art without departing from the spirit and scope of the invention.

What is claimed is:

1. A liquid electrostatographic developer, comprising:

a non-polar liquid carrier;

a halogenated charge director soluble or sparingly soluble in the liquid carrier having a structure as follows:

$$CX_3-(CX_2)_m-(CH_2)_n-R$$

wherein X is independently Cl, F or Br;

m ranges from 3-20;

n ranges from 2-30; and

R is hydrogen, or an optionally substituted hydrocarbon; and toner particles.

2. The liquid developer of claim 1, comprising about 0.05 to about 50 grams of a saturated solution of the charge director compound in the liquid carrier per gram of toner solids.

3. The liquid developer of claim 1, comprising about 0.1 to 30 grams of a saturated solution of the charge director compound in the liquid carrier per gram of toner solids.

4. The liquid developer of claim 1, comprising about 0.1 to about 5 grams of a saturated solution of the charge director compound in the liquid carrier per gram of toner solids.

5. The liquid developer of claim 1, wherein the liquid carrier has a kauri-butinol value of about 25 to about 30.

6. The liquid developer of claim 1, wherein the liquid carrier has a kauri-butinol value of about 27 to about 28.

7. The liquid developer of claim 1, wherein said charge director comprises a mixture of fluorosurfactants of the structure:

$$CX_3-(CX_2)_m-(CH_2)_n-R$$

wherein R is $-SO_3^-Q^+$ and Q is H or $NH_4$ n at least one fluorosurfactant and R is $$-O-\underset{\underset{O}{\|}}{C}-C_{17}H_{35}$$

in at lest one other fluorosurfactant.

8. The liquid developer of claim 1, wherein said charge director comprises a mixture of fluorosurfactants of the structure:

$$CX_3-(CX_2)_m-(CH_2)_n-R$$

wherein R is $-S-CH_2-CH_2-COO^-Li^+$ in at least one fluorosurfactant ad R is $$-O-\underset{\underset{O}{\|}}{C}-C_{17}H_{35}$$

in a least one other fluorosurfactant.

9. The liquid developer of claim 1, wherein said charge director comprises a mixture of fluorosurfactants of the structure:

$$CX_3-(CX_2)_m-(CH_2)_n-R$$

wherein R is $-S-CH_2-CH_2-N^+(CH_3)_3CH_2CO_2^-$ in at least one fluorosurfactant and R is $$-O-\underset{\underset{O}{\|}}{C}-C_{17}H_{35}$$

in at least one other fluorosurfactant.

10. A liquid electrostatographic developer comprising a non-polar liquid carrier; a halogenated charge director soluble or sparingly soluble in the liquid carrier and at least partly present in the form of charge director micelles; and toner particles.

11. A liquid developer of claim 10, wherein said halogenated charge director contains a halocarbon portion and an optionally substituted hydrocarbon solubilizing portion.

12. A liquid developer of claim 10, wherein said toner particles comprise a colorant.

13. A liquid developer of claim 12, wherein said colorant is present in an amount of from about 0.1 to about 60 percent of total weight of solids in the developer.

14. A liquid developer of claim 10, further comprising adjuvants selected form the group consisting of polyhydroxy compounds which contain at least 2 hydroxy groups, aminoalcohol, polybutylene succinimide and metallic soaps.

15. The liquid developer of claim 11, wherein said charge director has a structure as follows:

$$CX_3-(CX_2)_m-(CH_2)_n-R$$

Wherein X is independently Cl, F or Br;

m ranges from 3-20;

n ranges from 2-30; and

R is hydrogen, or an optionally substituted hydrocarbon solubilizing portion.

16. The liquid developer of claim 15, wherein X is a fluorine atom.

17. The liquid developer of claim 15, wherein R is a hydrocarbon substituted with at least one substituent selected from the group consisting of $$-O-\underset{\underset{O}{\|}}{C}-C_{17}H_{35}$$

$$-S-(CH_2)_n-N-R$$

—$SO_3$—$Q^+$, wherein Q is H or $NH_4$

—S—$CH_2$—$CH_2$—$COO^-Li^+$

—S—$CH_2$—$CH_2$—$N^+(CH_3)_3CH_2CO_2$—, and

—$PO_4^{-2}(NH_4^+)_2$.

18. The liquid developer of claim 15, wherein m ranges from 3–8.

19. The liquid developer of claim 10, wherein said non-polar liquid is an isoparaffinic hydrocarbon.

20. The liquid developer of claim 10, wherein said halogenated charge director is selected form the group consisting of:

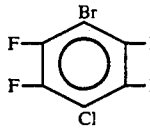

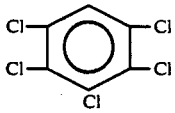

and

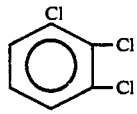

21. The liquid developer of claim 19, wherein said charge director is present in an amount of about 0.1 to about 50 grams of a saturated solution of a charge director per gram of toner solids.

* * * * *